US010823520B2

(12) United States Patent
Curry

(10) Patent No.: US 10,823,520 B2
(45) Date of Patent: Nov. 3, 2020

(54) BALANCED ROTATING DROP SAFETY

(71) Applicant: Smith & Wesson Corp., Springfield, MA (US)

(72) Inventor: Brett Curry, Monson, MA (US)

(73) Assignee: Smith & Wesson Inc., Springfield, MA (US)

( * ) Notice: Subject to any disclaimer, the term of this patent is extended or adjusted under 35 U.S.C. 154(b) by 29 days.

(21) Appl. No.: 16/442,611

(22) Filed: Jun. 17, 2019

(65) Prior Publication Data

US 2019/0390928 A1 Dec. 26, 2019

Related U.S. Application Data

(60) Provisional application No. 62/687,297, filed on Jun. 20, 2018.

(51) Int. Cl.
*F41A 17/64* (2006.01)

(52) U.S. Cl.
CPC ..... *F41A 17/64* (2013.01)

(58) Field of Classification Search
CPC ..... F41A 17/24; F41A 17/64; F41A 17/66; F41A 17/74; F41A 17/76
See application file for complete search history.

(56) References Cited

U.S. PATENT DOCUMENTS

| | | | | |
|---|---|---|---|---|
| 4,121,364 | A | 10/1978 | Kaltenegger | |
| 4,270,295 | A | 6/1981 | Grehl | |
| 4,395,839 | A | 8/1983 | Eder | |
| 4,454,673 | A | 6/1984 | Meidel | |
| 6,374,526 | B1 * | 4/2002 | Mochak | F41A 17/24 42/70.08 |
| 6,539,658 | B1 * | 4/2003 | Hubert | F41A 17/74 42/70.08 |
| 8,245,427 | B2 | 8/2012 | Gomez | |
| 9,726,449 | B2 | 8/2017 | Spinner et al. | |
| 2017/0003093 | A1 * | 1/2017 | Spinner | F41A 17/64 |
| 2017/0167813 | A1 * | 6/2017 | Gorcynski | F41C 3/00 |

FOREIGN PATENT DOCUMENTS

| | | |
|---|---|---|
| EP | 1281924 | 2/2003 |

* cited by examiner

*Primary Examiner* — J. Woodrow Eldred
(74) *Attorney, Agent, or Firm* — John A. Chionchio, Esq.; Ballard Spahr LLP

(57) ABSTRACT

A safety for a firearm has a blocking lever with an arresting lobe that engages a plunger. The arresting lobe and plunger are statically counterbalanced about a pivot axis by a counterbalance lobe on the blocking lever. The blocking lever is movable between a safe position, where it engages and prevents motion of a firing element, and a fire position, where it cannot engage the firing element. A cam, moved by the trigger, moves the plunger, which moves the blocking lever from the safe to the fire position to permit discharge of the firearm upon further pull of the trigger.

20 Claims, 4 Drawing Sheets

BALANCED ROTATING DROP SAFETY

CROSS REFERENCE TO RELATED APPLICATIONS

This application is based upon and claims benefit of priority to U.S. Provisional Application No. 62/687,297, filed Jun. 20, 2018, the application being hereby incorporated by reference.

FIELD OF THE INVENTION

This application concerns safety mechanisms for firearms.

BACKGROUND

When a firearm is dropped in a ready to fire condition (live round chambered, hammer cocked, or striker under spring load and restrained by the sear) the inertial loads imposed on the firearm by impact on a hard surface can cause the hammer or striker to fall off the sear and discharge the weapon, known as "searing off". Firearms may employ "drop" safeties which are intended to prevent the firearm from inadvertently discharging when subjected to shock or other inertial loads. However, many drop safeties will nevertheless allow inadvertent discharge if the inertial loads are imposed on the firing mechanism at a particular angle at which the drop safety fails to remain engaged. It is difficult to know at which angles a drop safety might be ineffective, and furthermore impossible to control the angle at which inertial forces will be imposed on a drop safety when a firearm is dropped. There is clearly an opportunity to improve the safety of firearms by reducing or eliminating the sensitivity of drop safety operation to the angle at which inertial loads are imposed.

SUMMARY

The invention concerns a safety for a firearm having a barrel and a firing element movable along a firing axis aligned with the barrel. In one example embodiment the safety comprises an engagement surface positioned on the firing element. The engagement surface is oriented transversely to the firing axis. A blocking lever is mountable within the firearm proximate to the firing element. The blocking lever is rotatable about a pivot axis. The blocking lever comprises an arresting lobe positioned on one side of the pivot axis and a counterbalance lobe positioned on an opposite side of the pivot axis. A plunger is mountable within the firearm and engageable with the arresting lobe. The plunger is movable transversely to the pivot axis. Motion of the plunger rotates the blocking lever about the pivot axis between a safe position, wherein the arresting lobe is engageable with the engagement surface of the firing element, and a fire position, wherein the arresting lobe cannot engage the engagement surface of the firing element. A spring is adapted to bias the arresting lobe into the safe position.

In an example embodiment the pivot axis is oriented parallel to the firing axis. In a further example the spring acts on the counterbalance lobe. In one example embodiment the firing element comprises a firing pin. In another example embodiment the firing element comprises a striker. By way of example the engagement surface comprises a shoulder projecting outwardly from the firing element. In a particular example the plunger comprises a recess adapted to receive the arresting lobe. In an example embodiment the counterbalance lobe statically balances the arresting lobe and the plunger about the pivot axis.

An example embodiment may further comprise a cam movably mountable within the firearm. In this example the plunger comprises a cam follower surface engageable with the cam. Motion of the cam into and out of engagement with the cam follower surface moves the plunger transversely to the pivot axis. By way of example a spring may be adapted to bias the cam out of engagement with the plunger.

The invention also encompasses a firearm. In one example embodiment the firearm comprises a barrel having a firing axis aligned with the barrel. A firing element is mounted within the firearm and movable along the firing axis. A safety comprises an engagement surface positioned on the firing element and oriented transversely to the firing axis. A blocking lever is mounted within the firearm proximate to the firing element. The blocking lever is rotatable about a pivot axis and comprises an arresting lobe, positioned on one side of the pivot axis, and a counterbalance lobe, positioned on an opposite side of the pivot axis. A plunger is mounted within the firearm and is engageable with the arresting lobe. The plunger is movable transversely to the pivot axis. Motion of the plunger rotates the blocking lever about the pivot axis between a safe position, wherein the arresting lobe is engageable with the engagement surface of the firing element, and a fire position, wherein the arresting lobe cannot engage the engagement surface of the firing element. A spring biases the arresting lobe into the safe position.

In an example embodiment the pivot axis is oriented parallel to the firing axis. Further by way of example the spring acts on the counterbalance lobe. In an example embodiment the firing element comprises a firing pin. In another example embodiment the firing element comprises a striker. By way of example the engagement surface comprises a shoulder projecting outwardly from the firing element. In an example embodiment the plunger comprises a recess adapted to receive the arresting lobe. In another example the counterbalance lobe statically balances the arresting lobe and the plunger about the pivot axis.

An example embodiment further comprises a cam movably mounted within the firearm. In this example the plunger comprises a cam follower surface engageable with the cam. Motion of the cam into and out of engagement with the cam follower surface moves the plunger transversely to the pivot axis. In an example embodiment the cam is pivotably mounted within the firearm. An example embodiment further comprises a spring adapted to bias the cam out of engagement with the plunger.

An example firearm embodiment further comprises a trigger movably mounted on the firearm. A trigger bar extends from the trigger and is engageable with the cam. Motion of the trigger moves the cam.

DETAILED DESCRIPTION

Figure 1:
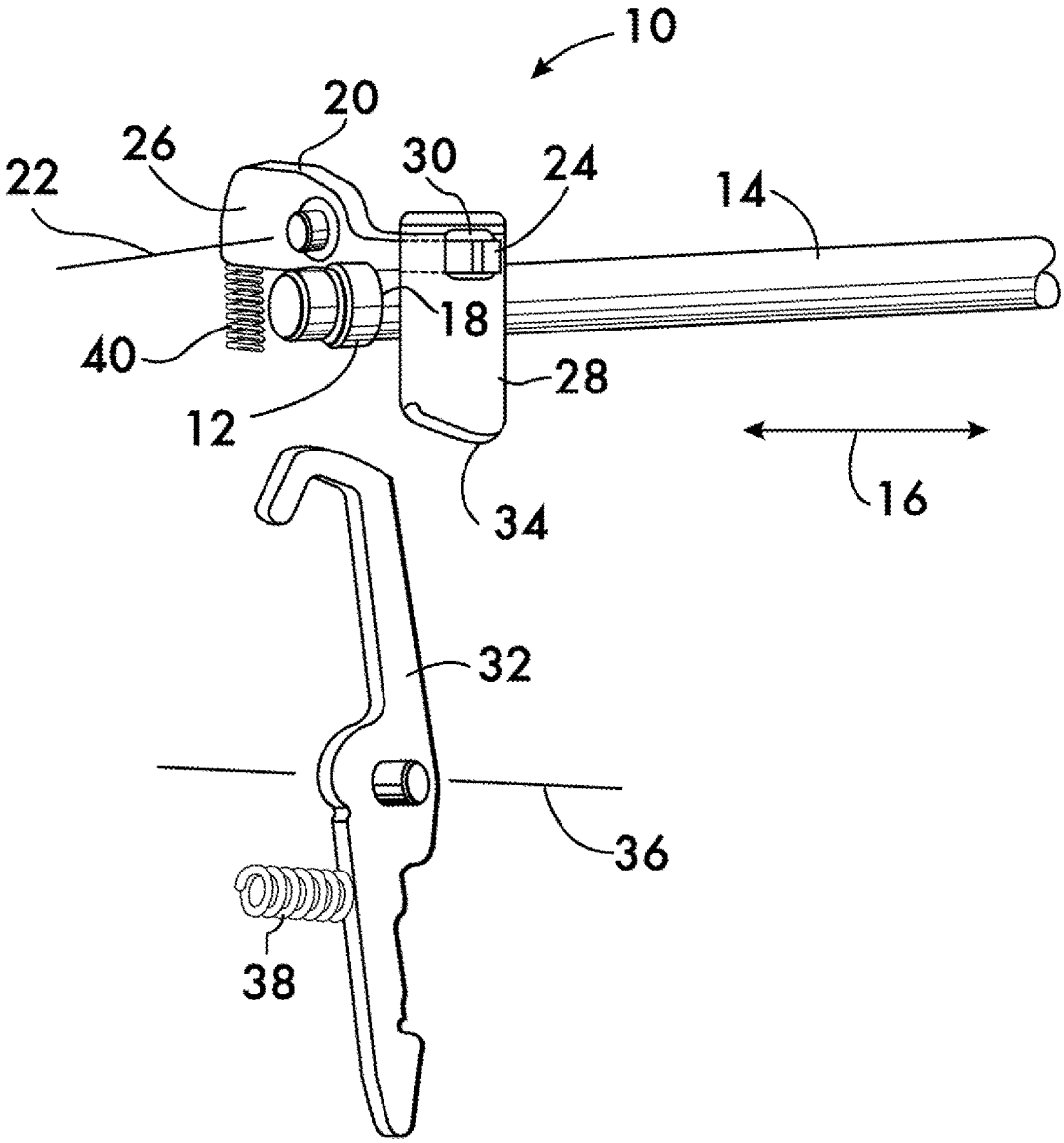
FIG. 1 is an isometric view of an example embodiment of a safety mechanism according to the invention shown in the "safe" position.

FIG. 1 shows an example embodiment of safety 10 for a firearm. Safety 10 comprises an engagement surface 12 positioned on a firing element 14 of the firearm. The firing element 14 may comprise, for example, a firing pin or a striker, and is movable along a firing axis 16 of the firearm to strike a primer of a centerfire cartridge or the rim of a rim fire cartridge to discharge the cartridge. In this example the engagement surface 12 is oriented transversely to the firing axis 16 and comprises a shoulder 18 projecting outwardly from the firing element 14.

A blocking lever 20 is mounted within the firearm proximate to the firing element 14. Blocking lever 20 is rotatable about a pivot axis 22 and comprises an arresting lobe 24 positioned on one side of the pivot axis, and a counterbalance lobe 26 positioned on an opposite side of the pivot axis. In this example pivot axis 22 is oriented parallel to the firing axis 16. A plunger 28 is mounted within the firearm and is engageable with the arresting lobe. In this example embodiment the plunger 28 comprises a recess 30 adapted to receive the arresting lobe 24. Plunger 28 is movable transversely to the pivot axis 22. Motion of the plunger 28 is effected by a cam 32 mounted within the firearm. Plunger 28 comprises a cam follower surface 34 which is engageable with the cam 32, and motion of the cam into and out of engagement with the cam follower surface 34 moves the plunger 28 transversely to the pivot axis 22. In this example embodiment the cam 32 pivots about an axis 36 and is biased to a position out of engagement with the cam follower surface by a spring 38 acting on the opposite side of the cam pivot axis 36.

Figure 2:
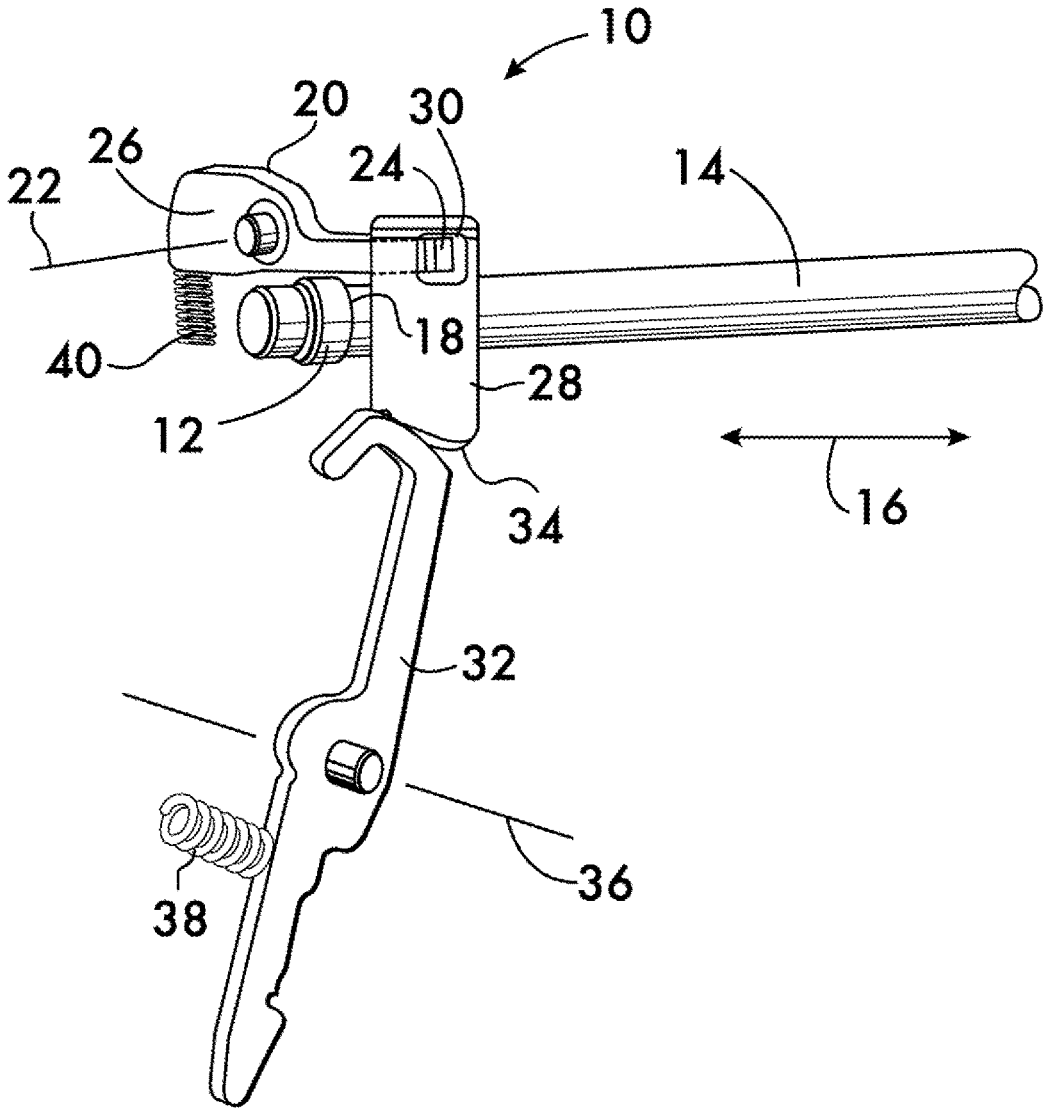
FIG. 2 is an isometric view of the safety mechanism of FIG. 1 shown in the "fire" position.

Through engagement between the plunger 28 and the arresting lobe 24, motion of the plunger rotates the blocking lever 20 about its pivot axis 22 between a "safe" position, wherein the arresting lobe 24 is engageable with the engagement surface 12 (shoulder 18) of the firing element 14, and a "fire" position, shown in FIG. 2, wherein the arresting lobe cannot engage the engagement surface 12. When blocking lever 20 is in the safe position (FIG. 1) the arresting lobe 24 prevents motion of the firing element 14 in a direction along firing axis 16 which would discharge a round. When blocking lever 20 is in the fire position (FIG. 2) the firing element 14 is free to move along the firing axis 16 and the firearm may be discharged. In this example embodiment a spring 40 acts on the counterbalance lobe 26 to bias the blocking lever 20 into the safe position. The counterbalance lobe 26 is sized and positioned to statically balance the arresting lobe 24 and the plunger 28 about the pivot axis 22 of blocking lever 20, i.e., the counterbalance lobe 26 exerts the same moment about the pivot axis 22 as do the arresting lobe 24 and plunger 28. Consequently, regardless of the direction of any inertial force to which the firearm may be subjected, as when it is dropped, no net moment will be experienced by the blocking lever, and thus it will be maintained in the safe position by its biasing spring 40.

Figure 3:
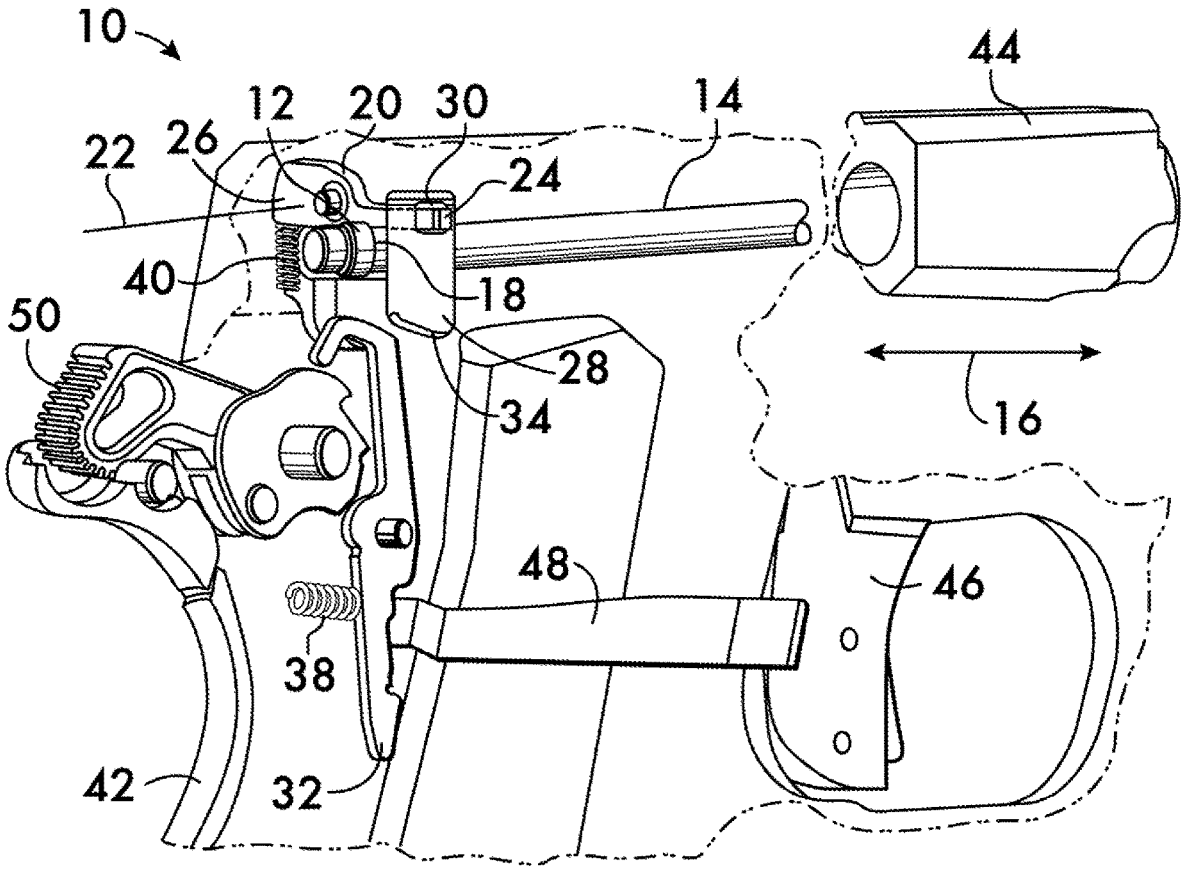
FIGS. 3 and 4 are isometric views of a firearm illustrating the operation of an example embodiment of a safety mechanism according to the invention.

Operation of the safety 10 according to the invention is described with reference to FIGS. 3 and 4. As shown in FIG. 3, the safety 10 is mounted within a firearm 42, in this example a semiautomatic pistol chambered for centerfire ammunition and having a firing element 14 comprising a firing pin. Firearm 42 comprises a barrel 44 coaxially aligned with the firing axis 16 and a trigger 46 movably mounted on the firearm. A trigger bar 48 extends from the trigger 46 and is engageable with the cam 32. A hammer 50 is mounted on the firearm, the hammer being released upon a pull of the trigger to strike the firing element 14 (firing pin) and discharge a chambered round.

FIG. 3 shows the safety 10 in the safe position (see also FIG. 1), with the arresting lobe 24 of the blocking lever 20 engageable with the engagement surface 12 (shoulder 18) of the firing element 14. When the blocking lever 20 is in this position, firearm 42 will not discharge if the hammer is inadvertently released (known as "searing off"), for example, by inertial forces imposed when the firearm is dropped. The arresting lobe 24 is held in a position where it will engage the engagement surface 12 of the firing element 14 and prevent its motion when struck by the hammer 50.

Figure 4:
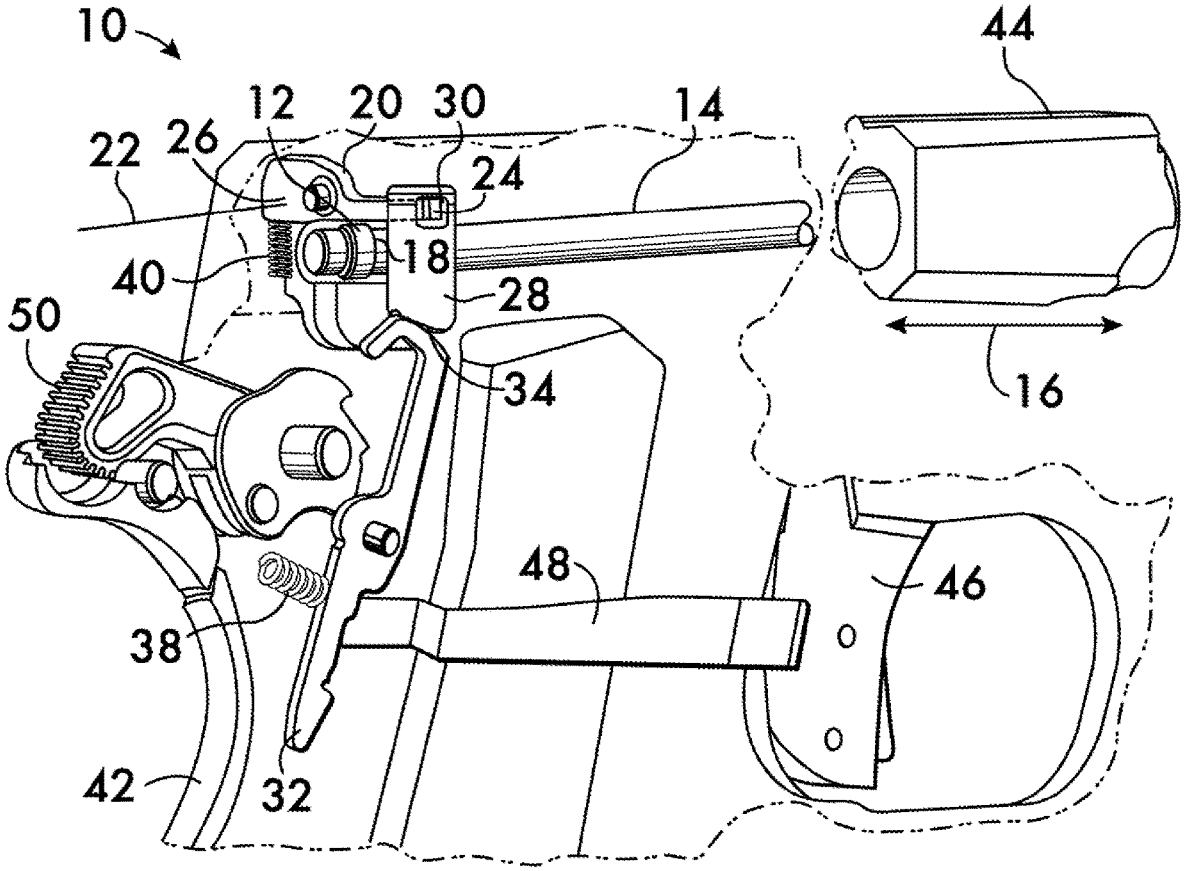

FIG. 4 shows the firearm 42 just before an intended discharge. As trigger 46 is pulled the trigger bar 48 engages the cam 32, moving the cam into engagement with the cam follower surface 34 of the plunger 28. Action between the cam 32 and the plunger 28 moves the plunger transversely to the pivot axis 22 of the blocking lever 20. Engagement of the plunger 28 with the arresting lobe 24 of the blocking lever 20 pivots the blocking lever from the safe to the fire position. A further pull of the trigger will release the hammer 50, which will then strike the firing element 14. Unrestrained by the arresting lobe 24 of the blocking lever 20, the firing element 14 will move along the firing axis 16 to strike a primer of a chambered round (not shown) to discharge the firearm.

It is expected that firearm safety will be improved by the use of balanced, biased blocking levers according to the invention because there is less chance of the safety disengaging under inertial force, as when the firearm is dropped, thereby preventing discharge even if the hammer sears off and strikes the firing element.

What is claimed is:

1. A safety for a firearm comprising a barrel and having a firing element movable along a firing axis aligned with said barrel, said safety comprising:

an engagement surface positioned on said firing element and oriented transversely to said firing axis;

a blocking lever mountable within said firearm proximate to said firing element, said blocking lever being rotatable about a pivot axis and comprising an arresting lobe, positioned on one side of said pivot axis, and a counterbalance lobe, positioned on an opposite side of said pivot axis;

a plunger mountable within said firearm and engageable with said arresting lobe, said plunger being movable transversely to said pivot axis, wherein motion of said plunger rotates said blocking lever about said pivot axis between a safe position, wherein said arresting lobe is engageable with said engagement surface of said firing element, and a fire position, wherein said arresting lobe cannot engage said engagement surface of said firing element; and a spring adapted to bias said arresting lobe into said safe position.

2. The safety according to claim 1, wherein said pivot axis is oriented parallel to said firing axis.

3. The safety according to claim 1, wherein said spring acts on said counterbalance lobe.

4. The safety according to claim 1, wherein said engagement surface comprises a shoulder projecting outwardly from said firing element.

5. The safety according to claim 1, wherein said plunger comprises a recess adapted to receive said arresting lobe.

6. The safety according to claim 1, wherein said counterbalance lobe statically balances said arresting lobe and said plunger about said pivot axis.

7. The safety according to claim 1, further comprising a cam movably mountable within said firearm, said plunger comprising a cam follower surface engageable with said cam, motion of said cam into and out of engagement with said cam follower surface moving said plunger transversely to said pivot axis.

8. The firearm according to claim 7, further comprising a spring adapted to bias said cam out of engagement with said plunger.

9. A firearm, said firearm comprising:

a barrel having a firing axis aligned with said barrel;

a firing element mounted within said firearm and movable along said firing axis;

a safety comprising:

an engagement surface positioned on said firing element and oriented transversely to said firing axis;

a blocking lever mounted within said firearm proximate to said firing element, said blocking lever being rotatable about a pivot axis and comprising an arresting lobe, positioned on one side of said pivot axis, and a counterbalance lobe, positioned on an opposite side of said pivot axis;

a plunger mounted within said firearm and engageable with said arresting lobe, said plunger being movable transversely to said pivot axis, wherein motion of said plunger rotates said blocking lever about said pivot axis between a safe position, wherein said arresting lobe is engageable with said engagement surface of said firing element, and a fire position, wherein said arresting lobe cannot engage said engagement surface of said firing element; and a spring adapted to bias said arresting lobe into said safe position.

10. The firearm according to claim 9, wherein said pivot axis is oriented parallel to said firing axis.

11. The firearm according to claim 9, wherein said spring acts on said counterbalance lobe.

12. The firearm according to claim 9, wherein said firing element comprises a firing pin.

13. The firearm according to claim 9, wherein said firing element comprises a striker.

14. The firearm according to claim 9, wherein said engagement surface comprises a shoulder projecting outwardly from said firing element.

15. The firearm according to claim 9, wherein said plunger comprises a recess adapted to receive said arresting lobe.

16. The safety according to claim 9, wherein said counterbalance lobe statically balances said arresting lobe and said plunger about said pivot axis.

17. The firearm according to claim 9, further comprising a cam movably mounted within said firearm, said plunger comprising a cam follower surface engageable with said cam, motion of said cam into and out of engagement with said cam follower surface moving said plunger transversely to said pivot axis.

18. The firearm according to claim 17, wherein said cam is pivotably mounted within said firearm.

19. The firearm according to claim 17, further comprising a spring adapted to bias said cam out of engagement with said plunger.

20. The firearm according to claim 17, further comprising:

a trigger movably mounted on said firearm;

a trigger bar extending from said trigger and engageable with said cam, motion of said trigger moving said cam.

* * * * *